United States Patent [19]

McNeil

[11] 3,951,410

[45] Apr. 20, 1976

[54] BOARD GAME APPARATUS

[76] Inventor: Andrew R. McNeil, 6 Pilgrim's Lane, London NW3, England

[22] Filed: Jan. 10, 1975

[21] Appl. No.: 539,938

Related U.S. Application Data

[63] Continuation-in-part of Ser. No. 431,627, Jan. 8, 1974, abandoned.

[30] Foreign Application Priority Data

Jan. 11, 1973 United Kingdom ..... 1632/73

[52] U.S. Cl. ..... 273/134 AC; 273/131 BB

[51] Int. Cl.[2] ..... A63F 3/04

[58] Field of Search ..... 273/131, 134

[56] References Cited

UNITED STATES PATENTS

| | | | |
|---|---|---|---|
| 940,855 | 11/1909 | Clemens | 273/134 AC |
| 2,470,632 | 5/1949 | McLeod | 273/134 AC |
| 3,851,881 | 12/1974 | Smith | 273/134 AC |

FOREIGN PATENTS OR APPLICATIONS

| | | | |
|---|---|---|---|
| 1,472,162 | 1/1967 | France | 273/134 AC |
| 1,141,463 | 1/1969 | United Kingdom | 273/131 BB |

*Primary Examiner*—Delbert B. Lowe
*Attorney, Agent, or Firm*—Kurt Kelman

[57] ABSTRACT

The equipment for a board game includes a game board depicting the map of a geographic area divided into a multiplicity of adjoining individual areas, preferably of varying sizes. Some of these areas are marked with the names of towns. A plurality of playing pieces are provided for the use of the players, a first group of these playing pieces representing two rival contending power blocs to be controlled by respective ones of the players, and a second group of playing pieces representing units of power to be moved by the players at their turn of play. A first pack of cards to be dealt to the players includes at least some cards marked with indicia each representing units of power allocated to the players holding the cards. The indicia on these cards is identical to indicia on the playing pieces of the second group, and some of the individual map areas are marked with these indicia to indicate home sites for the playing pieces marked with the same indicia. A second pack of cards to be drawn by the players at their turns carry information determining the movement of the playing pieces of the second group to respective ones of the individual map areas.

6 Claims, 5 Drawing Figures

10
11
12
RICHARD
OF YORK
LE ROSE
100
PLYMOUTH

13
EARL
OF
DEVONSHIRE
COURTENAY
OKEHAMPTON
30

14
EARL
OF
ESSEX
COLCHESTER
20
15
WARDEN
of the
CINQUE PORTS
SHIPS
LE TRINITY
LE GEORGE
OF RYE
CARRY 150 MEN
PEVENSEY
50
16
BRISTOL
17
BISHOP
OF
DURHAM
DURHAM
18
LE ROSE
SHIP
OF
PLYMOUTH
19
COMPANY
OF
SCOTS
ARCHERS
20

BOARD GAME APPARATUS

This is a continuation-in-part of my copending application Ser. No. 431,627, filed Jan. 8, 1974, now abandoned.

The present invention relates to a board game, and more particularly to equipment for a board game which may be played by two or more players.

The game is designed to enable the players to enact on a board depicting the map of a geographic area events reflective of a defined and specific historic period of that geographic area. While not limited thereto, the game will be described herein by way of example in connection with a map of England and Wales, and is designed to recreate the period in England's history best known as the Wars of the Roses.

The game comprises a board depicting an area map, two packs of cards and a plurality of playing pieces. Rules are provided to guide the playing of the game.

The board of the game depicts a map of a geographic area in a specified period of history. It is divided into areas or squares, which may be of varying sizes, the size of each area being in inverse proportion to the difficulty of traversing the natural terrain of that individual area. In other words, a large-sized square indicates a plain or ocean easily traversed while a small-sized area indicates a mountainous, desolate, marshy or otherwise treacherous terrain. Traversing a large-sized area will thus move a playing piece in a single move per square a larger distance than when the piece traverses a small-sized area.

Some of the areas have indicated thereon indicia or indications whose significance in the game may derive from the rules and/or may appear in a key printed on the board, as will be more fully explained hereinafter. Some of the areas are marked with the names of specific sites, such as towns, cities, ports and home sites or strongholds, for example, castles.

The playing pieces for use by respective ones of the players are marked with indicia unique to each piece. A first group of the playing pieces is marked by indicia representing two rival contenting power blocs and to be controlled by respective ones of the players, and a second group of the playing pieces is marked by indicia representing units of power and to be moved by respective ones of the players at their turn of play. The two rival contending power blocs, whose control is at stake in the game, are represented herein by the cotending Houses of Lancaster and York in the Wars of the Roses, and the indicia on the playing pieces of the first group are heraldic devices representing the members of these Houses. Obviously, these power blocs could be contending political parties, rival gangs, or political or royal contenders in other eras and other countries, etc., in which case the map would depict a corresponding geographic area within a corresponding specified period of time, with the indicia and the names of specific sites changed accordingly to indicate, for instance, State capitals, political strongholds, etc. Since the playing pieces of the first group are to be captured and controlled by the players, they are called hereinafter "prize" playing pieces. The playing pieces of the second group represent basic units of play or power, and are, therefore, designated hereinafter as "basic" playing pieces.

A first pack of cards to be dealt to respective ones of the players contains cards marked with indicia each representing units of power allocated to the player holding the cards. These indicia are identical with the indicia on the playing pieces of the second group, and some of the individual map areas are marked with these indicia to indicate home sites for the playing pieces marked with the same indicia. In the example herein described, these indicia are heraldic devices representing nobles, and the home sites are castles owned by these nobles. Each card or noble has a predetermined number of units of power or play so that each such playing piece moves with this amount of power. The first pack of cards may additionally comprise a group of cards with indicia augmenting the units of power of the first-named cards when held by the same player and carrying selected ones of the names of the specific sites. In the example herein described, the indicia on this group of cards include such as title holders in the king's service appropriate to the time, and the names are those of towns or ports, for instance, assuring the holder free passage therethrough. Since all of the cards of the first pack give power to the player holding them, they are designated hereinafter as "power" cards.

A second pack of cards to be drawn by respective ones of the players at their turns carry information determining the movement of the playing pieces of the second group to respective ones of the individual map areas. They may additonally carry information resolving conflicts arising from the movement of the playing pieces held by different ones of the players. These cards are designated hereinafter as "contingency" cards.

The above and other objects and features of the game of the present invention will become more apparent from the following detailed description of a specific embodiment thereof, taken in conjunction with the accompanying drawing and the rules. In the drawing, FIG. 1 is a plan view of the game board showing a map of England and Wales, with the adjoining coast of France, of the 15th century, divided into areas of unequal size and carrying the names of castles, cities, towns, etc., as well as indicia, as hereinabove defined;

THE EQUIPMENT

Figure 1:
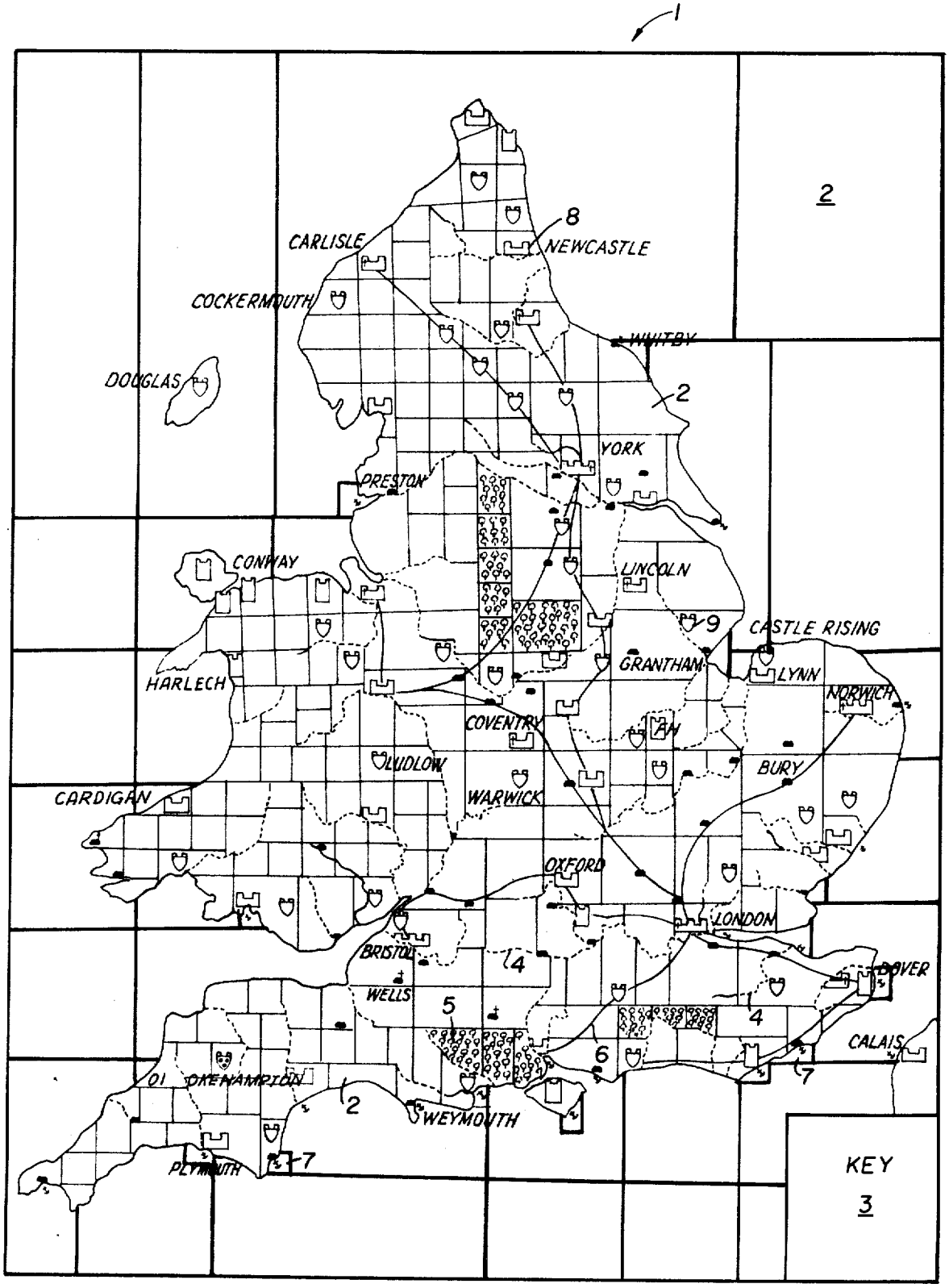

Referring now to the drawing, the game is illustrated and will be explained in connection with a game called "Kingmaker" which recreates the political and military struggle in England between the years 1450 and 1490, known as the Wars of the Roses. The power or basic units of play are represented by noble families noted by indicia constituted by heraldic devices of the families. The power of the noble families is augmented by power cards indicating high offices in the king's service appropriate to the period. The three main categories of contingency cards, i.e., raids and revolts, plague, and embassies, serve for the multitude of incidents which help or hinder military or political action. With these cards and the movements of the playing pieces they command, military conflicts are resolved, an attempt having been made to reflect two significant factors in warfare at that time: (*a*) the importance of movement and (*b*) the general inability of castles to withstand lengthy sieges.

In the illustrated embodment, the board 1 depicting a map of a geographic area shows a map of England and Wales, the map being divided into individual areas or squares 2 of unequal size and showing the names of cities, towns, castles, cathedrals, ports, etc., as well as heraldic devices identical to the heraldic device indicia on the basic playing pieces and the power cards. It will also be useful to show key 3 on the board, which is a guide to the symbols used on the board. This key may advantageously show the following:

Cross (see Coventry) indicates a cathedral which is the only place coronation can take place.

Fortified and open towns and cities have garrisons and capacities indicated by the rules.

Rivers 4 have no effect on the movement of playing pieces unless the river also constitutes the boundary of a square.

Pieces may move through forests 5 only one square at a time unless moving on a road 6.

Roads permit unlimited movement unless blocked by a hostile town or castle.

Ports 7 are the only places where embarkation and disembarkation may take place, the small port square and the adjacent land square being treated as a single square.

Royal castles 8 have garrisons and a capacity to protect additional personnel indicated by the rules.

Ordinary castles have a garrison and a capacity to protect additional personnel indicated by the rules.

Figures 2, 3:
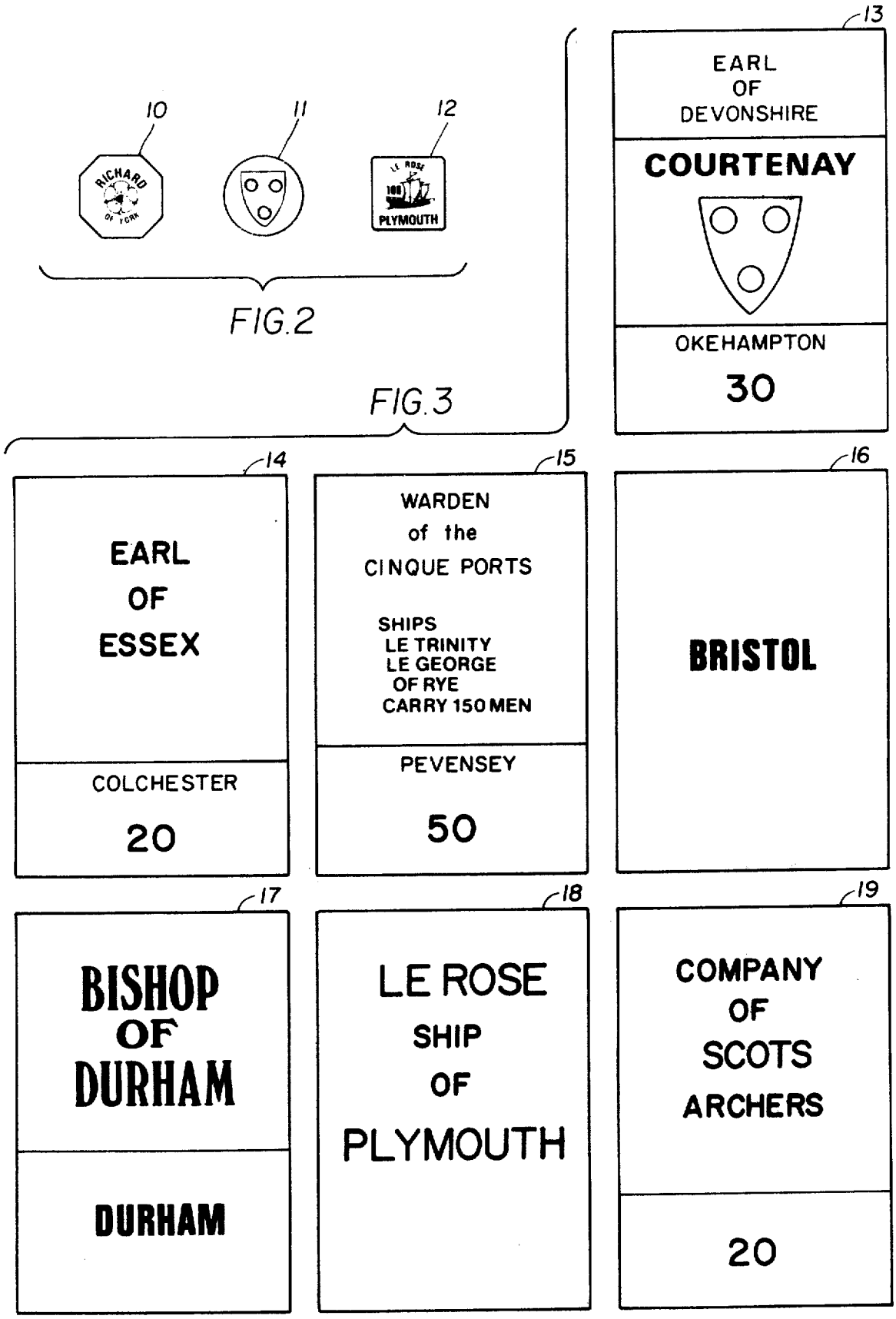
FIG. 2 shows illustrative samples of playing pieces.
FIG. 3 shows illustrative samples of power cards.

The playing pieces shown in FIG. 2 include prize playing pieces 10, and basic playing pieces including playing pieces 11 marked by heraldic device indicia and pieces 12 marked by ship indicia.

In the exemplified "Kingmaker" game, seven prize playing pieces represent, by their respective heraldic devices, the members of the contending Houses of Lancaster and York. These pieces, which represent rival power factions, are placed on the board before play begins in the following manner:

The Lancastrians: the king, Henry VI of Lancaster, in London; Margaret of Anjou, queen and regent for her son if Henry dies, in Fotheringhay (FH); and Edward of Lancaster, prince of Wales, in Coventry.

The Yorkists: Richard, duke of York, in York; Edward, earl of March, captured eldest son, in Harlech; George, duke of Clarence, his second son, in Cardigan; and Richard, duke of Gloucester, his youngest son, in Calais.

These seven prize playing pieces have no movement of their own. Once captures by players, they must always be accompanied by a basic playing piece representing power. They can be removed from play by the player whose power controls them.

Margaret of Anjou maintains her place in the Lancastrian succession even if her son, Edward of Lancaster, prince of Wales, dies.

Beaufort, one of the nobles representing power or a basic unit of play, may succeed as the last of the Lancastrians if he is in play when all other Lancastrians have been eliminated.

The Lancastrians and Yorkists may succeed to the throne only in the order of succession within their Houses.

In the illustrated Kingmaker game, 72 power cards are provided, including, as shown in FIG. 3, 23 cards 13 bearing the names and heraldic device indicia of nobles, eight cards 14 bearing titles which may be allocated to nobles not already bearing titles; 12 cards 15 bear the names of offices which may be conferred on nobles bearing titles; ten cards 16 have names of towns and one such card has the name of a castle; 4 cards 17 have the names of bishops and 2 such cards have those of archbishoprics; 4 cards 18 have ships; and 8 cards 19 have details of companies of mercenaries. Obviously, more or fewer power cards may be provided, thus extending the time it takes to complete a game or shortening this time. Instead of indicating nobles, the power cards may indicate political leaders of two parties, political offices, towns and state capitals, religious or civic leaders, air squadrons and the like, all coordinated to serve in a struggle for power between two rival blocs or factions.

Each card 13, 14 and 15 carries a number from 10 to 100 to show its value in basic power or playing units. Cards 13 also indicate the castles they own and carry the heraldic devices of the respective nobles, which indicia are shown on respective playing pieces 11 which represent these nobles in play. The following cards 13 are provided: Percy, Earl of Northumberland; Fitzalan, Earl of Arundel; Talbot, Earl of Shrewsbury; Stafford, Duke of Buckingham; Mowbray, Duke of Norfolk; Beaufort, Duke of Somerset; Neville, Earl of Warwick; Pole, Duke of Suffolk; Courtenay, Earl of Devonshire; Scrope; Berkeley; Hastings; Herbert; Clifford; Holland; Cromwell; Stanley; Grey; Roos; Greystoke; Bourchier; Howard; and Audley.

Cards 14 include the Earl of Westmoreland; Duke of Exeter; Earl of Wiltshire; Earl of Kent; Earl of Salisbury; Earl of Essex; Earl of Worcester; and Earl of Richmond.

Cards 15 each show a value of 50, except for the Marshal of England, with a value of 100, and further indicate the towns or cities through which they may pass freely. They include the Chancellor of England; Marshal of England; Steward of Royal Household; Constable of Dover Castle; Treasurer of England; as well as the Chancellor of the Duchy of Cornwall carrying a notation that its value is increased to 100 in Devon and Cornwall; Admiral of England carrying the notation that the ships Le Margaret of Lynn and Le Christopher of Southampton carry 200 men; Chancellor of the Duchy of Lancaster increased to 100 within three squares of Conway; Chamberlain of the County Palatine of Chester increased to 200 in Wales; Constable of the Tower of London increased to 200 within two squares of London; Warden of the Northern Marches increased to 100 north of the Rives Tees; and Warden of the Cinque Ports carrying the notation that the ships Le Trinity and Le George of Rye carry 150 men.

Cards 16 include Newcastle, Nottingham, Leicester, Swansea, Carisbrooke, Lancaster, Northampton, Coventry, Shrewsbury, Bristol and Ipswich.

Cards 17 show the seats of the bishops and include the Archbishop of Canterbury, Archbishop of York, Bishop of Durham, Bishop of Norwich, Bishop of Lincoln and Bishop of Carlisle.

Cards 18 include Le Swan, ship of Berwick; Le Michael, ship of Bristol; Le Lucas, ship of London; and Le Rose, ship of Plymouth, each having its corresponding playing piece 12.

Cards 19 carry numbers from 10 to 30 and include two each of the Company of Flemish Crossbowmen; of Burgundian Crossbowmen; of Saxons; and of Scots Archers.

Figure 4:
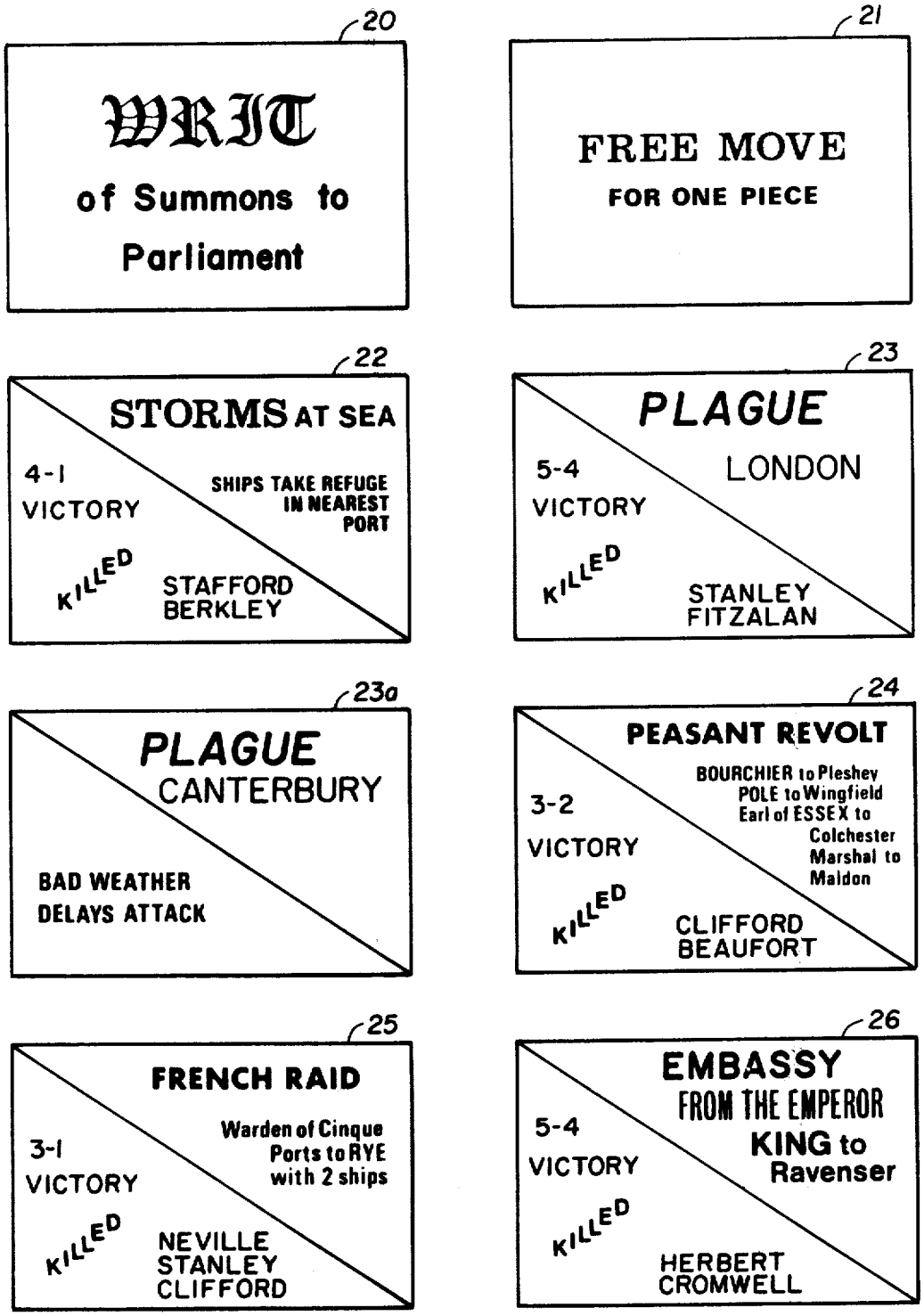
FIG. 4 shows illustrative samples of contingency cards.
Figure 5:
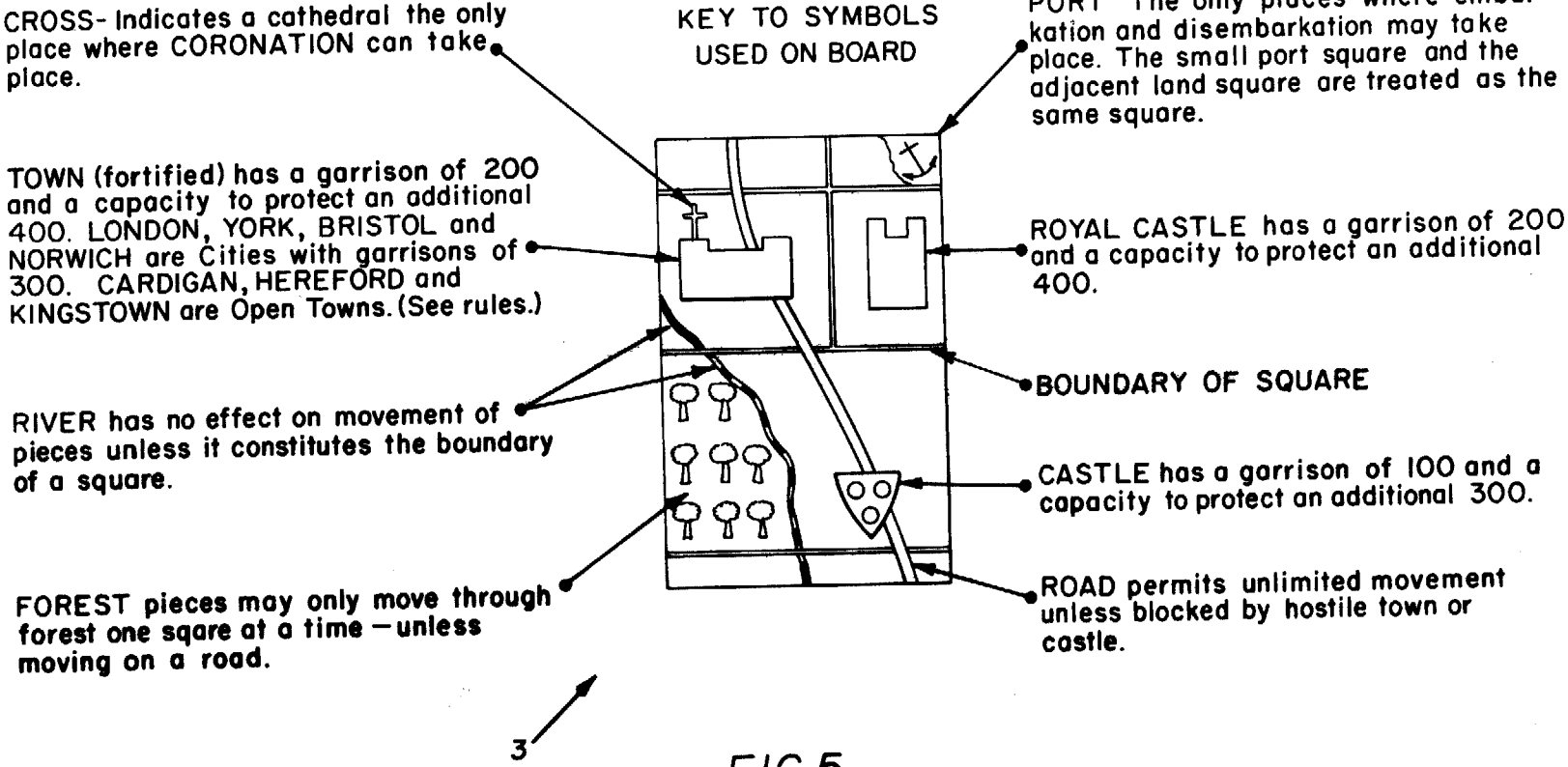
FIG. 5 shows the key.

The contigency cards illustrated in FIG. 4 generally require a playing piece to be moved to a designated area 2 and cover a great range of contingencies. It will be obvious from the specific examples given in connection with the Kingmaker game, which outline circumstances consistent with the enactment of events during that period, that a wide variety of directions may be imprinted on these cards. In the Kingmaker game the pack of contingency cards includes ten cards 20 and 21 each respectively indicating a writ of summons to parliament and a free move for one piece, respectively. Furthermore, this pack also contains a plurality of contingency cards giving in one half of the card directions for moving specific playing pieces and telling in the other half of the card what happens to resolve conflicts. These contingency cards include, by way of example, the following:

Ten cards 22 indicating storms at sea during which the playing pieces indicating ships take refuge in the nearest port. The other half of these cards indicates such conflict resolutions as:

4–1 victory, killed: Stafford, Berkeley.
5–4 victory, killed: Pole, Roos.
3–1 victory, killed: Audley, Holland.
3–2 victory, killed: Pole, Percy, Audley.
5–4 victory, killed: Holland, Hastings.
4–1 victory, killed: Stanley, Hastings, Mowbray.
2–1 victory, killed: Pole, Scrope.
2–1 victory, killed: Roos, Holland.
2–1 victory, killed: Grey, Clifford.
5–4 victory, killed: Audley, Howard.

Seventeen cards 23 and **23*a* indicate plague at certain towns or cities imprinted in one half of the cards while some of these cards 23 indicate in the other half the same type of happenings indicated on cards 22 while the other cards 23*a*** of this group indicate merely that bad weather delays attack.

There are six cards **23*a*** respectively indicating the plague to strike Southampton; Lancaster and Chester; Plymouth and Exeter; Norwich and Lynn; Lincoln and Newark; and Canterbury.

Eleven cards 23 indicate:

| Plague | Conflict Resolution |
|---|---|
| Cardigan and Swansea | 4-1 victory, killed: Scrope, Holland, Fitzalan |
| Shrewsbury and Hereford | 3-2 victory, killed: Courtenay |
| Colchester and Ipswich | 4-1 victory, killed: Roos, Beaufort, Neville |
| Newcastle and Durham | 5-4 victory, killed: Scrope, Holland |
| Nottingham, Leicester and Coventry | 3-1 victory, killed: Scrope, Cromwell |
| Bristol | 2-1 victory, killed: Percy, Stafford, Fitzalan |
| York and Kingston | 3-2 victory, killed: Stafford, Greystoke |
| Northampton and Oxford | 4-1 victory, killed: Pole, Fitzalan |
| London | 5-4 victory, killed: Stanley, Fitzalan |
| Carlisle | 5-4 victory, killed: Courtenay, Greystoke |
| Berwick | 3-2 victory, killed: Scrope, Howard, Mowbray |

Ten cards 24 indicate a peasant revolt during which the playing pieces take the action imprinted in one half of the cards while the other half of these cards indicate the same type of happening indicated on cards 22.

Five cards 25 indicate French raids and follow the same pattern as the cards 24, as do five additional cards indicating Scots raids, one card indicating a revolt in Wales and two cards indicating piracy. As indicated in the Table hereinbelow, which shows conflict resolutions, nobles have to move to their home castles in case of peasant revolts or piracies.

Four like contingency cards indicate in one half that parliament may be summoned by the chancellor while the other half of these cards indicate the same type of happenings indicated on cards 22.

Finally, six like contingency cards 26 indicate in one half the same type of happenings indicated on cards 22 while their upper half provides for different embassies of the king to (1) Ravenser, (2) Rochester, (3) Weymouth, (4) Rye, (5) Preston and (6) Maldon.

Ten cards 24 indicate:

| Peasant Revolt | Conflict Resolution |
|---|---|
| Bourchier to Pleshey<br>Pole to Wingfield<br>Earl of Essex to Colchester<br>Marshal to Maldon | 3-2 victory, killed: Clifford, Beaufort |
| Earl of Kent to Rochester<br>Constable of Dover Castle to Dover<br>Marshal to Black Heath | 2-1 victory, killed: Stanley, Berkeley |
| Mowbray to Framlingham<br>Bishop of Norwich to Norwich<br>Admiral to Lynn<br>Marshal to Thetford | Bad Weather Delays Attack |
| Neville to Raby<br>Scrope to Masham<br>Roos to Helmsley<br>Mowbray to Wressle<br>Archbishop of York to York<br>Marshal to Wakefield | 3-2 victory, killed: Talbot, Stanley |
| Mowbray to Castle Rising<br>Marshal to Thetford | 3-2 victory, killed: Hastings, Bourchier |
| Courtenay to Okehampton<br>Holland to Compton<br>Duke of Exeter to Exeter<br>Chancellor of Duchy of Cornwall to Plymouth<br>Marshal to Bodmin | Bad Weather Delays Attack |
| Mowbray to Denbigh<br>Fitzalan to Chirk<br>Chancellor of Duchy of Lancaster to Conway<br>Chancellor of County Palatine of Chester to Rhuddlan | Bad Weather Delays Attack |
| Mowbray to Framlingham<br>Marshal to Thetford | 2-1 victory, killed: Talbot, Neville, Courtenay |
| Stafford to Leeds<br>Earl of Kent to Rochester<br>Marshal to Black Heath | 3-1 victory, killed: Grey, Hastings. |
| Stafford to Leeds<br>Archbiship of Canterbury to Canterbury<br>Marshal to Black Heath | 2-1 victory, killed: Audley, Cromwell |

Cards 25 indicate:

| French Raid | Conflict Resolution |
|---|---|
| Admiral to Rye with 2 ships<br>Warden of Cinque Ports to Rye with 2 ships | 4-1 victory, killed: Audley, Bourchier |
| Warden of Cinque Ports to Rye with 2 ships<br>Courtenay to Okehampton<br>Holland to Compton | 3-1 victory, killed: Neville, Stanley, Clifford<br>5-4 victory, killed: Grey, Talbot |
| Admiral to Plymouth with ships<br>Bourchier to Pleshey<br>Pole to Ipswich | Bad Weather Delays Attack |
| Admiral to Ipswich with 2 ships<br>Warden of Cinque Ports to Pevensey with 1 ship | 4-1 victory, killed: Clifford, Courtenay |

| Scots Raid | Conflict Resolution |
|---|---|
| Percy to Alnwick<br>Warden of Northern Marches to Berwick | Bad Weather Delays Attack |
| Percy to Cockermouth<br>Earl of Westmoreland to Preston | Bad Weather Delays Attack |

-continued

| Peasant Revolt | Conflict Resolution |
|---|---|
| Bishop of Carlisle to Carlisle | |
| Warden of Northern Marches to Berwick | |
| Warden of Northern Marches to Berwick | 3-2 victory, killed: Grey, Berkeley |
| Warden of Northern Marches to Bamburgh | 3-1 victory, killed: Talbot, Stafford, Mowbray |
| Warden of Northern Marches to Bamburgh | 5-4 victory, killed: Berkeley, Beaufort |
| **Revolt in Wales** | **Conflict Resolution** |
| Talbot to Ludlow | 5-4 victory, killed: Clifford, Bourchier |
| **Piracy** | **Conflict Resolution** |
| Fitzalan to Arundel | 4-1 victory, killed: Cromwell, |
| Beaufort to Corfe | Greystoke |
| Stanley to Douglas | 3-1 victory, killed: Howard, Fitzalan |

The four Parliament May be Summoned by the Chancellor cards carry the following directions for conflict resolution: 3–1 victory, killed: Roos, Bourchier; 3–2 victory, killed: Roos, Neville, Cromwell; 2–1 victory, killed: Hastings, Beaufort; and 4–1 victory, killed: Talbot, Howard.

Cards 26 carry the following directions for conflict resolution: 5–4 victory, killed: Herbert, Cromwell; 3–2 victory, killed: Herbert, Holland; 4–1 victory, killed: Grey, Percy, Herbert; 2–1 victory, killed: Herbert, Bourchier; 3–1 victory, killed: Percy, Berkeley, Courtenay; and 3–1 victory, killed: Beaufort, Herbert.

The illustrated game board depicts a map of England and Wales divided into squares 2 and having marked thereon the chief towns, castles, roads, rivers and forests which determine play. To simplify the drawing, only a few of the towns and castles have been shown in FIG. 1, other such towns and castles being well known to the historian and geographer of the era.

The playing pieces include seven prize playing pieces 10 representing royal pretenders, including the actual king Henry VI, and basic playing pieces 11 and 12 representing units of power in the form of ships and nobles with their households and armies.

The board, the playing pieces and the two packs of cards are so designed and interrelated that the players participating in the game may enact historic or simulated events of the Wars of the Roses, i.e., the military and political struggle for power which took place in England between the years 1450 and 1490. Any other power struggle in any other period of time in any other geographic area of the world may be similarly enacted with suitably designed maps, and matching indicia on playing pieces and cards, with directions matching the events of such other eras.

The map of England and Wales used in the Kingmaker game has imprinted thereon, in respective ones of squares or areas 2:

The four cities of London, York, Bristol and Norwich.

The 26 towns of Berwick, Newcastle, Carlisle, Durham, Lancaster, Kingston, Chester, Lincoln, Newark, Nottingham, Lynn, Shrewsbury, Leicester, Coventry, Northampton, Cardigan, Hereford, Ipswich, Colchester, Oxford, Swansea, Canterbury, Southampton, Exeter, Plymouth and Calais (on the coast of France).

Eleven royal castles indicated by respective symbols and the words Bambrugh, Beaumaris, Caernavon, Conway, Rhuddlan, Harlech, Fotheringhay (FH), Wallingford, Dover, Pevensey and Carisbrooke.

Thirty-five ordinary castles indicated by respective heraldic design indicia identical to those appearing on the basic playing pieces to indicate control of that castle by the respective power or basic unit of play, which is a noble family in the case of the Kingmaker game. These castles are also indicated by their names, as the following list shows, each name or group of names being followed by the name (in parentheses) of the noble family owning the named group of castles: Rockingham (Grey); Appleby (Greystoke); Raby, Richmond, Warwick and Ogmore (Neville); Masham (Scrope); Helmsley and Belvoir (Ross); Wressle, Castle Rising, Framlingham, Denbigh and Usk (Mowbray); Douglas (Stanley); Conisborough (Clifford); Chirk and Arundel (Fitzalan); Tattershall (Cromwell); Tickhill (Audley); Tutbury (Hastings); Newcastle and Leeds (Stafford); Ludlow (Talbot); Llanstephan (Herbert); Wingfield (Pole); Kimbolton and Compton (Holland); Berkeley (Berkeley); Farnham (Howard); Corfe (Beaufort); Okehampton (Courtenay); and Pleshey (Bourchier).

The map also has imprinted thereon such areas as may assist or restrict the movement of the playing pieces, such as forests, roads, ports and areas of sea.

The power cards allocate to the players owning them their power or basic units of play. The varying strengths of these units from 100 to 10 men are indicated on cards 13 representing the noble families. These cards also have imprinted thereon the name of the castles controlled by the respective noble families. This basic power is variously augmented by the ownership by the same player of power cards 14, 15 and 19, each also carrying an indication of the strength in manpower each represents. This basic power is further augmented by ownership of other power cards allocating ships, towns and castles, as well as bishops.

As indicated hereinabove, the contingency cards shown in FIG. 4 bear information enabling players to resolve conflicts between one or more playing pieces in supposed battles or sieges, or may require the conflict to be postponed, as may be appropriate to the situation. The cards may also enable extra moves to be made by the playing pieces and/or to enforce the movement of other playing pieces, indicated by a writ of summons to parliament.

Having thus described the equipment required for the game, the rules of the Kingmaker game will now be set forth.

The Rules

The object of the game is for a player to control one royal pretender (prize) who has no possible rivals (prizes) held by any other player.

After the seven prize playing pices have been placed on the royal castles and towns indicated hereinabove, cards from the pack of power cards are dealt to the players. If two players participate, each receives 18 power cards; three players: 12 cards; four players: 9 cards; five players: 7 cards; and for each additional player, each player receives one card less.

After the power cards have been dealt to each player, he first separates "noble" cards 13 from the remainder of his cards. Each of these cards bears a heraldic device indicium and is represented on the board by a playing piece 11 bearing the same indicium. Each player now places the separated noble cards on the table and allocates his remaining cards to respective ones of his noble cards in any manner the player desires, subject only to the restriction that no noble card 13 may have allocated to it more than one title card 14, including a hereditary title which may already be on the noble card, and more than one office card 15. Only nobles bearing a title may hold an office.

If a player receives no noble card 13 during the original deal, he is dealt cards from the pack of power cards until he does.

For example, assuming the player has three cards 13, e.g., "Earl of Northumberland", "Earl of Arundel" and "Audley". He lays them on the table. He also has one of each of the other power cards, i.e., a "title" card 14, e.g., "Duke of Exeter", an "office" card 15, e.g., "Chancellor of the Duchy of Lancaster", a "town" card 16, e.g., "Leicester", a "bishop" card 17, e.g., "Archbishop of Canterbury", a "ship" card 18, e.g., "Le Swan, Ship of Berwick", and a "mercenary" card 19, e.g., "Company of Flemish Crossbowmen". The player now decides to assign or allocate cards 18, 16 and 19 to the "Earl of Northumberland", cards 15 and 17 to the "Earl of Arundel" and card 14 to "Audley". Once so allocated to a "noble" card 13, no power cards may be transferred, except for the voluntary transfer of power cards 15, 16, 17, 18 and 19, which may be undertaken in Parliament. The noble involved in such a transfer need not be present at parliament in such a transfer but at least one member of this "faction" must be.

Once exposed, during the deal or in the course of the game, noble cards must be allocated to a noble. Any player who fails to do so forfeits the noble card in question, which is placed on the bottom of the noble pack.

Any power cards (offices or titles) which cannot be allocated during the deal are placed face down in a pile at some convenient place or on near the board. This pile is referred to as chancery.

The households thus established, each player may now place the playing piece 11 carrying the heraldic device indicium indicating the respective noble of the household on a castle in one of the individual areas of the map which belongs to that noble in his own right (as indicated on the respective power card 13). Any ships represented by playing pieces 12 are placed on their port of origin, as indicated on the respective power card 18.

Each playing piece 11 carries not only the basic power or unit of play of the noble card, i.e. 100 for the Earl of Northumberland, but also that of the power cards assigned or allocated to his household, i.e., in the given example, 20 for the Company of Flemish Crossbowmen, so that the playing piece will be worth 120 in any conflict, in addition to owning Leicester which it may, therefore, enter freely without having to defeat a garrison there, as well as the castles of Alnwick and Cockermouth, indicated as owned by the Earl of Northumberland.

In the course of play, if a noble enters play when his own castle is occupied by an unfriendly, i.e., another player's party, the player owning this noble card may place the corresponding playing piece at the nearest friendly town or castle, i.e., a town or castle which is not occupied or occupied by one of the other households owned by the same player.

The board carries the following markings:

Castles belonging to the nobles, as indicated on power cards 13, are marked on the map with the heraldic device of the noble appearing on his card. Each castle has a permanent garrison of 100 men and can afford protection for an additional 300.

Royal castles carry no heraldic device and have a garrison of 200 men, affording protection for an additional 300.

Towns are named and marked on the board with a symbol representing a town gateway surmounted by two towers. They have garrisons of 200 and afford protection for an additional 400.

The four cities of London, Norwich, York and Bristol have garrisons of 300 and afford protection for an unlimited number of additional men.

There are three open towns — Cardigan, Hereford and Kingston — which offer no resistance if attacked when unoccupied. Their garrisons of 200 men, however, will protect any force occupying them. Occupation cannot be made permanent.

All castles and towns resist attack even when not allocated to any noble. Nobles of the same faction, i.e., held by the same player, may enter the castles and towns of each other freely, and the garrisons will protect them.

In the course of play, castles and towns may be captured by other players. It is advisable to place counters on allocated and captured castles and towns to indicate ownership. The counter may simply consist of blank playing pieces provided in addition to the indicia — carrying pieces. These pieces may be of different colors assigned to respective players.

Players may offer possession of castles and towns to other players at any time. Unlike transfers within a faction this does not have to be undertaken during Parliament. Such offers may be part of a bargaining procedure developed during the play. One player may, for instance, offer another player possession of a castle or town in exchange for the other player's agreement not to hinder a certain move of the one player. If such offer is accepted, the counter playing piece of the one player is simply replaced by that of the other player to signify the change in ownership or occupation.

Play proceeds as follows:

When all playing pieces have been placed on the board, play begins with the player holding the office of Chancellor of England. If no one holds the office, play begins with the senior bishop in the order: Canterbury, York, Durham, Carlisle, Lincoln, Norwich.

At the start of each player's turn, he draws a contingency card from the pack placed face down on the table to determine circumstances affecting his playing pieces and he moves the pieces in accordance with the instructions on the draw contingency card. The player may move any or all of his playing pieces up to five individual areas or squares per turn. When a conflict is to be settled, another card is drawn from the contingency pack, and at the end of the turn, the player draws a power card from the chancery pack.

Taking the above specific example, the playing piece representing the Earl of Northumberland being worth 120 units of play, this piece located on its castle augments the garrison from 100 to 220 men in any conflict that may arise. Assuming the player now draws a writ of summons to parliament or a free move card 20 or 21 from the pack of contingency cards, he retains the same for possible use at his discretion and is permitted to move his playing piece or pieces by five squares.

Movement along roads is unlimited but players cannot pass through a castle or town owned or occupied by another player unless this player has indicated his willingness to permit passage. Thus, castles and towns may block road movement. Unless on a road, forests in a square 2 also block movement, i.e., a playing piece entering a forest square must stop there. Road movement cannot be combined with ordinary movement and a playing piece must be on the square touched by the road at the start of the move along the road. If a player has a free move contingency card 21, he may move one of his playing pieces an additional five squares for each card. A free card move may be used to split a move along a road and one on ordinary squares, and card 21 is then returned to the pack by the player.

At his turn, a player may move all, some or none of his playing pieces any number of squares up to five. If a player decides not to move along a road, he may move in any direction and thus may perform a semi-circular movement to bypass an occupied town, for instance.

If the player draws at the start of his turn any other type of contingency card, account is taken of the information on one half of the card to direct the indicated move or moves. Assuming, for instance, in the above specific example, the player draws a contingency card 23 or 23*a* indicating the plague at the town of Leicester. When the plague strikes, everyone in the affected town or city, i.e., in the town of Leicester, is removed from the board and his offices, etc., indicated on respective power cards, are returned to the chancery, which is the unused pack of power cards.

Assuming the player draws a contingency card 24 or 25 indicating a raid or revolt, the playing piece representing the noble instructed by this contingency card must deal with this revolt or raid and proceed directly to the place named, regardless or whether he is owned by the player who drew the contingency card. If the drawn card instructs a noble to go to two places, perhaps one for himself and one for his office, he may choose where to go. Where the card instructs the noble to move to an enemy-occupied castle or town, the playing piece representing him may be placed on the same square, and is not considered to be inside that castle or town. Nobles who are at sea, or in Calais, do not have to obey the instruction given by the drawn contingency card.

Assuming the player draws a contingency card 26 indicating an embassy, a king who is the sole crowned king must attend immediately to the embassy, moving to the indicated location. He may take any noble in the faction controlling him with him to the place of the embassy's arrival.

If the player draws a contingency card indicating parliament may be summoned by the chancellor, the chancellor may summon parliament in the same move that in which the contingency card is drawn where there is no claimant to the throne who is crowned.

If on moving his playing piece or pieces by up to five squares or on obeying the instructions on the one half of the initially drawn contingency card, a battle or conflict ensues, i.e., the moving playing piece runs into an enemy-occupied square 2, a further contingency card is drawn by the player to give the results of the conflict indicated on the other half of the contingency cards 22 to 26. A castle or town is forced, i.e., the playing pieces can pass through it, only when a number of men, i.e., basic power or playing units, equal to the number in the castle or town is present. The second drawn contingency card determines the outcome of the ensuing battle. The other half of this contingency card shows the proportion the larger of the two forces will require for total victory, and also shows those nobles, if present, who are killed in the battle.

Thus, assuming the above-exemplified player who holds the Earl of Northumberland (120 basic playing units) and Audley (30 basic playing units) reaches a castle (garrison of 100) occupied by Neville (50 basic playing units), and the second contingency card drawn reads "3 – 1 victory, killed Audley, Holland", he successfully forces or captures the castle because he has a force (150) equal to that in the castle, but he must return his Audley card to the noble pack. If, however, instead of occupying a castle, Neville occupies open country square 2, and the contingency card drawn reads "4 – 1 victory, killed Audley, Bourchier" he would fail to gain a total victory. In open country, victory depends on the odds indicated on the contingency card, i.e., there is an element of chance, while he would still remove Audley from play.

On the other hand, if the proportion for total victory stated on the drawn contingency card is met, all the nobles on the losing side are captured and the corresponding power cards 16 to 19 may be taken by the victorious player and distributed among the households he owns. The noble cards 13, 14 themselves are either killed, i.e., returned to the "noble" pack, or freed, i.e., returned to the player who held the card, rather than being added to the victor's faction. The only thing a player cannot do is to add the noble card to his own collection. In most cases, he will want to remove it from play but cases may arise where players strike a bargain and the noble card is not removed from play but allowed to continue as part of the faction of the player who originally held it.

While the cards 13 of all nobles killed are returned to the noble pack, the cards 14 or 15 of any title or office held by the killed noble are placed on the chancery pile, face down. Any other cards are returned to the botton of the noble pack. Of course, any counter playing pieces on the board relating to the removed casualties must be removed from the board.

If, instead of victory figures and casualties, the second contingency card drawn merely indicates "bad weather", this delays attack in open country. Thus, the two forces remain in position until the next turn although the defending force may retreat when the turn of the player holding that force comes. Where an attacking player draws one of the cards indicating that "Bad Weather Delays Attack", the bad weather delays a siege on a castle and the occupants of the castle cannot leave. They can make a sallying attack from the castle against the besieging force. A noble under siege does not obey an order from a contingency card to go to another place, nor can he be removed to attend Parliament. The state of siege, however, is only maintained while the force attacking the castle remains at the strength required for taking the castle.

Where a smaller force attacks a larger, the proportion for total victory portion of the contingency card is taken into account, and the smaller force can be defeated in the normal way, the nobles and their possessions falling to the superior force.

Each ship can carry 100 men, with the exception of those ships belonging to the Admiral and the Warden of the Cinque Ports which can carry 200 and 150 men respectively.

As long as the ships remain together, a force can be split in any way between more than one ship.

Ships can only take on and put off passengers at ports, which are marked on the board with small anchors, and embarkation and disembarkation must take place with the ship and passengers remaining on the same square for the period between any two moves.

A free move cannot be used to speed up embarkation or disembarkation.

Ships cannot attack one another, nor may they block each other's passage.

Where a ship is in port and the passengers are on either the land square related to the port or on board ship they are still subject to attack. The port square and the adjacent land square are considered to be the same square.

A ship which changes ownership when carrying passengers is controlled by the former owner until the passengers have been disembarked, which must be when the ship next touches port.

Owners of castles or towns which are ports may prevent any ship from sailing from that port, but neither ships nor passengers are forfeited.

When the contingency card indicating storms at sea is drawn, all ships at sea are moved directly to the nearest port. Where two or more ports appear equal in distance, the owner of the ship may choose.

Where a sea-borne attack is delayed by bad weather, the passengers and the ships are treated as if they are in port, although they cannot be the object of sallying attack from a castle or town. They can be attacked by plague.

Since squares 2 provided in the sea area of the map are much larger than the squares in the land area, a player may rapidly move a basic unit of play represented by a ship playing piece 12 a long distance, for example from Dover to Whitby. In the same move, a playing piece 11 representing a noble may also be moved to Whitby, thus assembling a large force.

When all the moves ensuing from the drawing of the second contingency card have been completed and the player cannot take any further action, the player completes his turn by drawing a power card from the noble pack, which he may keep concealed. Now it is the turn of the next player.

It is possible for two or more players to join their forces in an alliance, in which case their playing pieces may be moved together in the first turn after conjunction made by the player who effected the conjunction.

Parliament may be summoned by a sole crowned king. The exception to this is when the chancellor may summon parliament in the turn in which he draws a contingency card to that effect, and then only when there is no sole crowned king.

The king who summons parliament must have the support of one other faction, a member of which he may summon by writ. Writ cards are drawn from the contingency pack, and may be kept by the player until they are required, when they should be replaced at the bottom of the pack.

Once parliament has been called, any noble may attend. When any nobles attending parliament are assembled, the player controlling the king draws as many cards from the top of the chancery pile as there are nobles present. He then distributes all the cards he has drawn to nobles in other factions as well as to those in his own, whether or not the nobles are present at parliament.

Following the distribution, players may transfer any allocated cards except titles.

Should there be any undistributed cards remaining after the allocation at parliament, they are placed at the bottom of the noble pack and are not replaced in the chancery pile.

Parliament must be summoned to a town where the king is present when the parliament is called.

Movement to a parliament is direct: movement away is in the normal up-to-5-squares manner and not directly back to where they were before. The player controlling the king first distributes the cards from the chancery pile. He must distribute them all if he can, to other factions as well as his own, whether or not those nobles to whom he distributes them are present at the parliament or not.

Following the distribution, players may transfer allocated cards if they wish, subject to the restriction that they cannot transfer titles.

Should there be any undistributed cards remaining after allocation at parliament, these cards are placed on the bottom of the noble pack, and are not replaced on the chancery pile.

Royal power can only be assumed after coronation, but Henry of Lancaster, as Henry VI, is already crowned king at the start of the game.

A coronation may only take place at one of the cathedral towns marked with a cross on the board, and there must be present, in person, either one archbishop or two bishops, although these bishops do not have to be in their own cathedral.

There may be more than one king crowned at the same time. For instance, if Richard, Duke of York, is moved to a cathedral city and one archbishop or two bishops are present, Richard may be crowned so that there are two rival crowned kings of the two contending Houses of Lancaster and York.

The object of every player is to control the king and maintain the power of the king he controls. The royal pieces, Yorkist or Lancastrian, may be captured by players but they may not be removed from the board except when killed, for instance by plague, and then they can never return.

No player may control both a Lancastrian and Yorkist playing piece 10 for more than two complete moves although he may hold more than one of one House. He must dispose of the royal piece he does not wish to retain either by death or by giving it to another player.

The winner of the game is the player whose faction controls one crowned royal piece who has no rival held by another faction.

Any argument over the rules and their interpretation must be settled by the officer of the crown most nearly concerned with the problem. Thus the Admiral settles any maritime disputes, the Marshal any disputes arising out of battles or military movement, the Archbishops any ecclesiastical troubles, and the Chancellor any arising from the constitution. If these offices are not allocated, the king may decide.

What is claimed is:

1. A game equipment enabling a plurality of players to enact in play events fitting into a specified geographic area within a specified period of time, comprising the combination of

1. a game board having thereon a map depicting a geographic area, a. the map being divided into a multiplicity of adjoining individual areas and b. some of the individual areas being marked with the names of specific sites;

2. a plurality of playing pieces for use by respective ones of the players, a. a first group of the playing pieces being marked by indicia representing two rival contending power blocs and to be controlled by respective ones of the players, and b. a second group of the playing pieces being marked by indicia representing units of power and to be moved by respective ones of the players at their turn of play;

3. a first pack of cards to be dealt to respective ones of the players, the cards of the first pack being marked with indicia each representing power allocated to the player holding the cards, the indicia on some of said cards being identical with the indicia on the playing pieces of the second group, and some of the individual map areas being marked with the indicia of the second group of the playing pieces to indicate home sites for the playing pieces marked with the same indicia; and 4. a second pack of cards to be drawn by respective ones of the players at their turns, a. the cards of the second pack carrying information determining the movement of the playing pieces of the second group to respective ones of the individual map areas.

2. The game equipment of claim 1, wherein the individual map areas differ in size.

3. The game equipment of claim 1, wherein the map is marked with additional indicia restricting or assisting the movement of the playing pieces of the second group.

4. The game equipment of claim 3, further comprising a key on the game board defining the meaning of the additional indicia assigned to the specific sites named on some of the individual map areas.

5. The game equipment of claim 1, wherein the geographic area is England and Wales and the names of the specific sites, the indicia and the information reflect a historic period of time of this area.

6. The game equipment of claim 1, wherein the cards of the second pack additionally carry information on how to determine an encounter of the playing pieces moved during play by different ones of the players to the same individual map area.

* * * * *